US006986432B2

(12) United States Patent
Limbach et al.

(10) Patent No.: US 6,986,432 B2
(45) Date of Patent: Jan. 17, 2006

(54) COMMON CAST DRAFT SILL FOR TYPE E AND F DRAFT GEAR

(75) Inventors: Paul A. Limbach, Edwarsville, IL (US); Andrew G. Kurtyak, Shorewood, IL (US); John F. Deppen, New Cumberland, PA (US); John F. Oesch, Grand Haven, MI (US)

(73) Assignee: ASF-Keystone, Inc., Granite City, IL (US)

( * ) Notice: Subject to any disclaimer, the term of this patent is extended or adjusted under 35 U.S.C. 154(b) by 0 days.

(21) Appl. No.: 10/766,930

(22) Filed: Jan. 30, 2004

(65) Prior Publication Data

US 2004/0245202 A1 Dec. 9, 2004

Related U.S. Application Data

(60) Provisional application No. 60/443,574, filed on Jan. 30, 2003.

(51) Int. Cl.
*B61G 7/10* (2006.01)

(52) U.S. Cl. ..... 213/51

(58) Field of Classification Search ..... 213/51, 213/40 R, 7, 75 R

See application file for complete search history.

(56) References Cited

U.S. PATENT DOCUMENTS

| | | | | |
|---|---|---|---|---|
| 2,850,178 A | | 9/1958 | Kozak | |
| 4,681,040 A | | 7/1987 | Brodeur et al. | |
| 5,704,296 A | * | 1/1998 | Gagliardino et al. | 105/420 |
| 5,931,101 A | * | 8/1999 | Kaufhold et al. | 105/420 |
| 6,305,298 B1 | | 10/2001 | Kaufhold et al. | |

(Continued)

FOREIGN PATENT DOCUMENTS

GB 2 173 754 A 10/1986

*Primary Examiner*—S. Joseph Morano
*Assistant Examiner*—Robert J. McCarry, Jr.
(74) *Attorney, Agent, or Firm*—Oliff & Berridge, PLC; Edward J. Brosius

(57) ABSTRACT

A common E/F type draft sill is provided that accommodates either Type E or Type F draft gear components, including rotary coupler applications. The draft sill is preferably cast, but may also be fabricated. The common E/F draft sill is provided with a fixed, integral spring basket of a Type F draft sill to accommodate and house standard spring-biased spring basket support systems and accommodate standard Type F draft gear. Standard vertical connection of Type F draft gear is provided. The common draft sill is also provided with the horizontal keyslot of a Type E draft sill to also accommodate attachment of Type E draft gear. A drop-in E coupler support is also available that replaces the "spring basket" support system used with Type F draft gear so as to allow proper support of Type E draft gear. Additional standardization and reduction of specialized castings can be achieved by incorporating both body bolster pads and body bolster wings on the common draft sill. Further standardization can be realized by providing a standardized machined end sill pad that accommodates a plurality of different design specifications for application with a plurality of different railcar specifications. Even further standardization can be realized by having flange hole patterns that accept multiple types of draft gear applications. Additional standardization can be achieved by having a standardized center sill facing end and a series of "plug-n-receiver" combinations in which an application-specific "plug" is provided that may be welded on the center sill facing end of the common draft sill to adapt it to a particular configuration.

20 Claims, 19 Drawing Sheets

U.S. PATENT DOCUMENTS 6,305,561 B1 * 10/2001 Kaufhold et al. ..... 213/51
6,324,995 B1 * 12/2001 Kaufhold et al. ..... 105/199.4
6,398,047 B1 6/2002 Ladendorf et al.
6,446,820 B1 9/2002 Barker et al.
6,681,943 B2 * 1/2004 Barker et al. ..... 213/75 R
2002/0070189 A1 6/2002 Barker et al.

* cited by examiner

COMMON CAST DRAFT SILL FOR TYPE E AND F DRAFT GEAR

CROSS-REFERENCE TO RELATED APPLICATIONS

This application claims the benefit of U.S. Provisional Patent Application No. 60/443,574 filed on Jan. 30, 2003.

BACKGROUND OF THE INVENTION

1. Field of Invention

The present invention relates to draft sills for use on railway freight cars. More particularly, the present invention relates to a common draft sill that can accommodate both Type E and Type F draft gears.

2. Description of Related Art

In a typical railway freight train, such as that shown in FIG. 1, railway cars 12, 14 are connected end to end by couplers 16, 18. Couplers 16, 18 are each received in draft sills 20, 22 of each respective car along with hydraulic cushioning or other shock-absorbing assemblies (unshown). Draft sills 20, 22 are provided at the ends of the railway car's center sill, and include center plates that rest in center plate bowls of railway car trucks 26, 28.

As shown in FIG. 2, each typical car truck 26 includes a pair of side frames 30, 32 supported on wheel sets 34, 36. A hollow bolster 38 extends between and is supported on springs 40 mounted on the side frames. A bolster center plate bowl 24 is provided having a central opening 42. The bolster center plate bowl 24 receives and supports a circular center plate of the draft sill 20.

FIG. 3 shows a typical cast draft sill mounted to the structure of a railroad freight car 12. In the mounted position, the cast draft sill 20 is secured to an end sill 44, the body bolster 38, and a center sill 46. The draft sill 20 typically has a top wall that is welded or otherwise affixed to a shear plate that is connected to the bottom of the railway car. The railway car center sill 46 typically runs the length of the car (but on some cars may extend around the periphery of the car depending on car configuration). Buff and draft forces are thus generally transferred between the draft sill structure, the car truck and the center sill of the car. The shown draft sill 20 has a draft gear mounted within a draft gear pocket and coupler 16 has its shank extend through the coupler shank opening at the outboard end thereof. A center filler plate 48 is mounted in the center filler plate pocket of the cast draft sill, such as by welding, or may be integrally formed. Center filler plate 48 is receivable within car body center plate 24. A sole plate 50 connects the body bolster 38 over the cast draft sill 20. The draft gear pocket has a pair of draft gear carrier members 52 mounted transversely thereto below draft gear cushioning unit 54. The draft gear carrier members 52 are connected to bottom flanges 56 of the draft sill. The end of the illustrated cast draft sill includes a fish-tail piece 58 that has a generally U-shaped opening 60. The fish-tail plate has a pair of facing horizontally disposed fillets that function to transmit and distribute forces from the draft sill 20 to sides of center sill 46 when the fillet plates and lip are welded to the railroad car center sill.

Currently, a draft sill (either cast or fabricated) is unique to the type of draft gear and coupler being used. There have evolved two primary types: Type E and Type F draft sills that accommodate either an E shank coupler or a F shank coupler. Exemplary known Type E draft sills are shown in FIGS. 4–6 while exemplary known Type F draft sills are shown in FIGS. 7–9. Additional details of standard draft sill casting processes and specifications can be found in, for example, ASF-Keysone's Draft Sill End Casting Finishing Standards (Revised Oct. 30, 1998) found at www.asfusa-.com/finisill.htm, the subject matter of which is incorporated by reference herein in its entirety.

The Type E draft sill may include center plate flange holes 62. Both Type E and Type F sills include a draft gear pocket 64 that receives a Type E or Type F draft gear assembly. Both types also may include various front draft lugs 66, rear draft lugs 68, flanges 70, king pin holes 72, king pin relief holes 74, lightener holes 76, safety plate flange holes 78, and shear plate surfaces 80. Some typical cast sills may also include side wall pads 82 or side wall "wings" or webs 84 depending on carbuilder requirements. Further, both types typically include a sill attachment telescoping surface 86, a striker face 88, an optional striker pad 90, and yoke support plate flange holes 92.

There are, however, many major differences between the two types. The front ends of both types are substantially different. Type F draft sills have a deep carrier basket 94 that receives a spring-biased carrier basket coupler support system that may or may not include wear plates 96. The spring-biased support allows limited vertical movement of the Type F coupler assembly. Type F draft sills also include retainer block mounting holes 100. Type E draft sills have no such spring-biased carrier basket system and instead have a fixed horizontal support surface forming a fixed coupler carrier 98 that supports a Type E coupler without vertical movement. The support surface will either have metallic or non-metallic wear plates applied. As such, the end profile looks more rectangular, without the downward extending basket. Type F draft sills also include a top yoke filler plate 102, top yoke filler plate weld holes 104, and yoke head support plate flange holes 106 that are not found on type E draft sills. Besides differences in support, the two types of draft sills also have entirely different coupler attachment mechanisms. For example, Type E draft sills have a cross-key connection 108 that mates horizontally within horizontal keyslot 110 to retain a Type E coupler. On the contrary, Type F draft sills rely on a vertical pin connector 112 to retain a type F coupler.

Each type of draft sill has evolved to adapt to and couple a particular draft gear coupler system, which is configured and suited to differing applications. For example, a Type E draft gear is typically used in short overhang railway cars such as 50' boxcars, intermodal well cars, covered hopper cars and bottom dump coal cars. A Type F draft gear is typically used in longer overhang railway cars such as 89' flat cars, centerbeam cars and large covered hopper cars. An additional, more expensive, form of Type F draft gear includes a rotary element in place of the standard draft gear yoke and follower that is free to rotate, allowing rotation of the draft sill relative to the draft coupler gear. This particular application is typically used in rotary dump coal cars in which the coal car is unloaded via the top by rotation of the coal car using the rotary element.

SUMMARY OF THE INVENTION

One existing problem being faced by manufacturers is the proliferation of tooling needed to supply railway carbuilders with cast draft sills for various combinations of car types, draft gear requirements and other unique carbuilder preferences. In addition to the differences in draft gear system choices mentioned above (fixed Type E, fixed Type F, and rotary Type F), there are many other subtle differences between cast sill designs. For example, certain draft sills require body bolster pads 82 for connection of the draft sill with the body bolster 38 of some car frames. Other draft sills require body bolster wings 84 for connection. Due to different railcar applications and manufacturer, there are also numerous differences in an end sill top striker pad 90 surface, which is a precisely referenced surface used for attachment of the draft sill to the railcar body. Additionally, there are various differences in draft sill total length and center sill mating end configurations necessary to properly align with and mate to various railcars. There also are differences in hardware configurations to properly mount different types of draft gear.

Currently, the assignee supports a possible 143 different combinations of cast draft sills to account for the above and other requirement differences. Managing this matrix in conjunction with complex supply chain requirements and short customer lead-times makes such a task difficult and expensive. Moreover, tooling and maintaining casting molds for such a large number of design combinations is also expensive and time consuming.

There is a need to reduce the tooling requirements, shorten lead times and achieve economy of scale benefits in the production of draft sills. Until now, it has been believed that there were too many differences in designs to provide a platform that could accept both Type E and Type F draft coupler gear. However, in exemplary embodiments of the invention, this has been achieved. Not only does the inventive common E/F draft sill allow for a reduction in total castings needed, but allows a railway car owner some flexibility in assigning a particular car to either inexpensive Type E coupler service or the more expensive rotary dump service by retrofitting the appropriate draft gear into the common draft sill without the need to completely replace the draft sill as well. That is, if the car is initially built for and assigned bottom dump service, it can be assembled with lower cost Type E draft gear. If at some time in the future the car is desired to be reassigned to rotary dump service, only portions of the draft gear system needs to be replaced, and not the entire draft sill.

In exemplary embodiments, this can be achieved by providing a common draft sill that incorporates the cast end structure of the Type F draft sill. However, a drop-in Type E coupler support replaces the "spring basket" support system used with Type F draft gear so as to allow proper fixed support of Type E draft gear. To further allow coupling of a Type E coupler, the common draft sill incorporates a horizontal keyslot that can receive a standard cross-key connection.

Similarly, in exemplary embodiments, a locking center pin is provided, along with a "spring basket" support system, so that Type F draft gear can be suitably attached and supported to the same common draft sill.

Further economics of scale and reduction of tooling can be attained by standardization of other features previously custom configured for each application. In exemplary embodiments this can be achieved by incorporating both bolster pads and bolster wings on the draft sill to standardize the draft sill for a plurality of fitting applications and carbuilder preferences.

Further standardization can be realized in exemplary embodiments which further include a standardized end sill pad that accommodates design specifications of a plurality of different railcar specifications.

Even further standardization can be realized in exemplary embodiments by having a standardized center sill facing end and a series of "plug-n-receiver" combinations in which an application-specific "plug" is provided that may be welded on the center sill facing end of the common draft sill to adapt it to a particular configuration without the need for an entire customized draft sill tooling (patterns, cores, molds, etc.).

By incorporating all of these standardization elements, it has been found that a single cast draft sill body can be provided that adapts to 80% of the current market, greatly reducing the previous requirements for 143 separate casting molds. This reduces labor costs, opens floor space for other manufacturing opportunities, reduces the number of parts ordered, received and inventoried, reduces material handling, and reduces capital investment and maintenance.

BRIEF DESCRIPTION OF THE DRAWINGS

The invention will be described with reference to the following drawings, wherein.

DETAILED DESCRIPTION OF PREFERRED EMBODIMENTS

Figure 1:
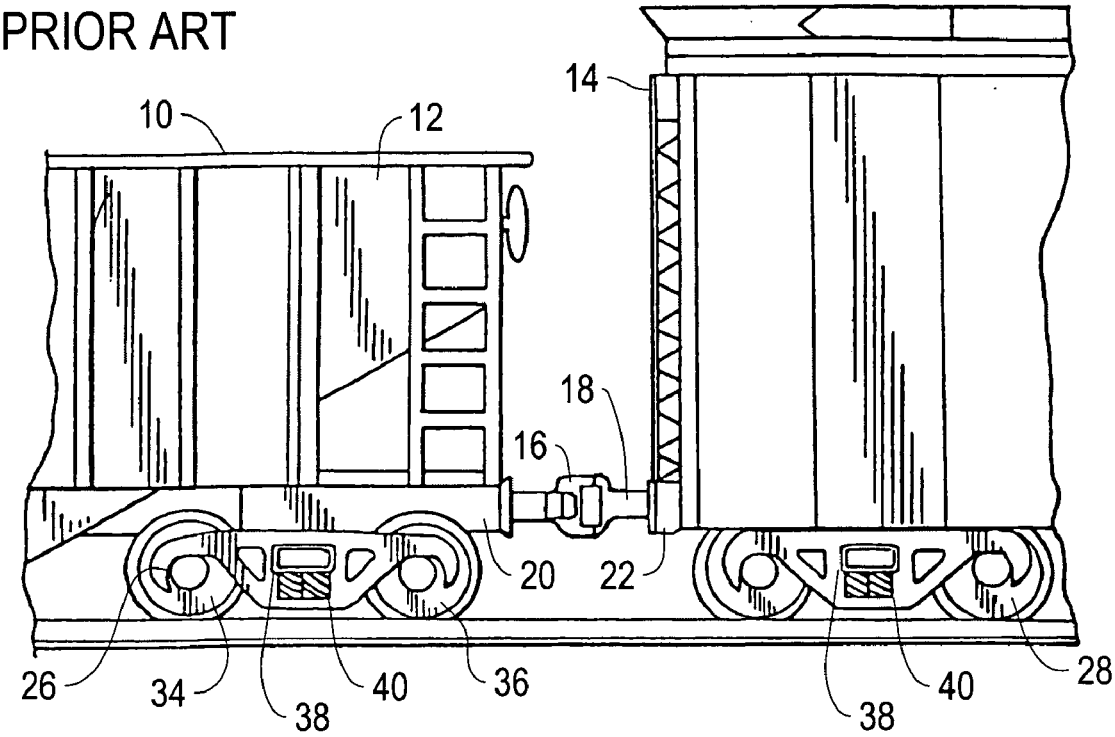
Fig. 1 PRIOR ART
FIG. 1 is a schematic elevation of the coupled ends of two typical railroad cars.
Figure 2:
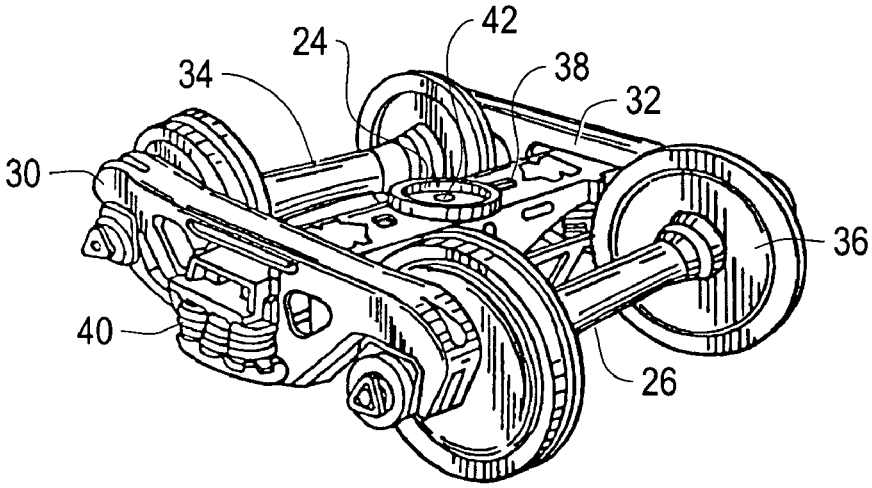
Fig. 2 PRIOR ART
FIG. 2 is a perspective view of a typical railway car truck for use with the present invention.
Figure 3:
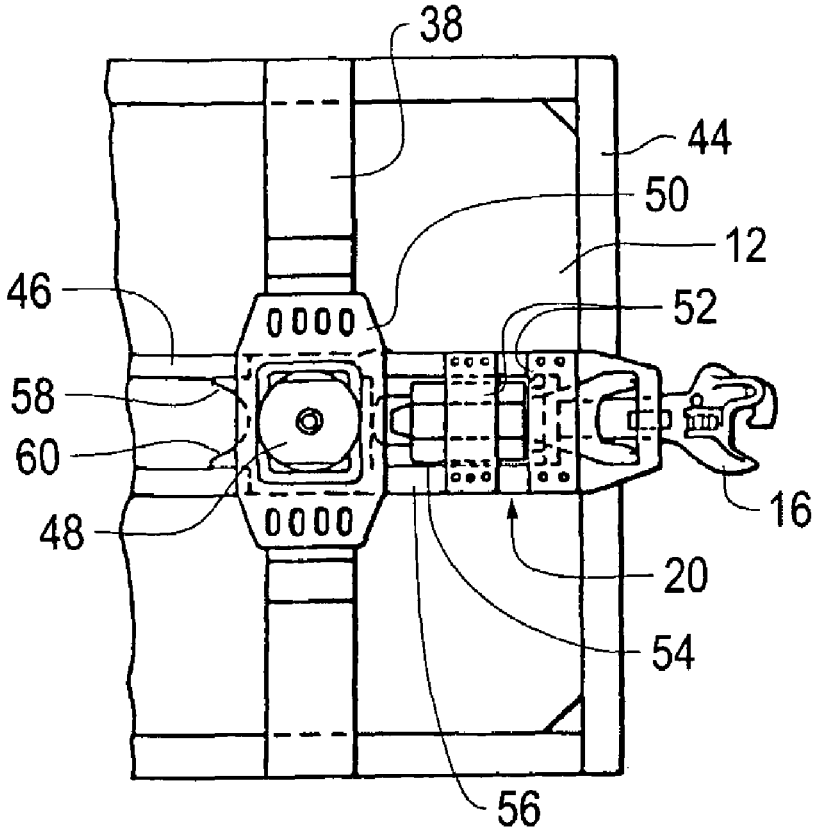
Fig. 3 PRIOR ART
FIG. 3 is a bottom view of one of the ends of the railroad cars of FIG. 1.
Figure 4:
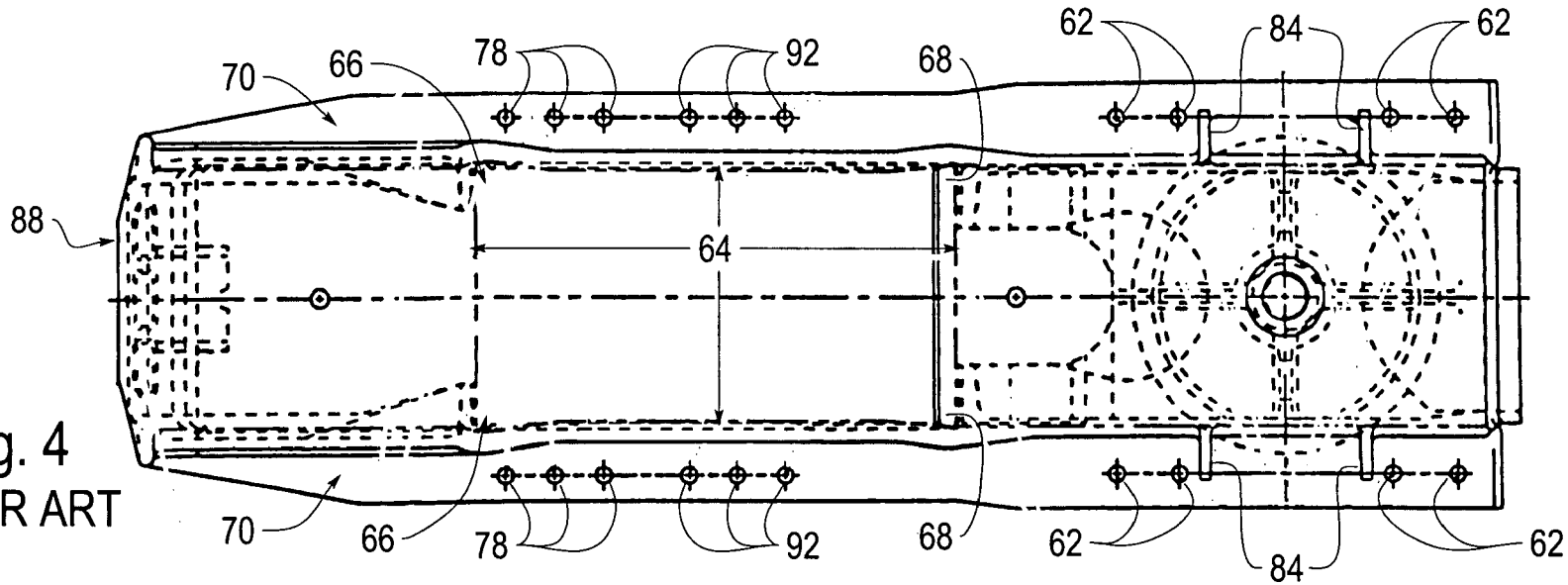
Fig. 4 PRIOR ART
FIGS. 4–5 are top and side views, respectively, of a typical prior art Type E draft sill end casting having an integral center plate.
Figure 5:
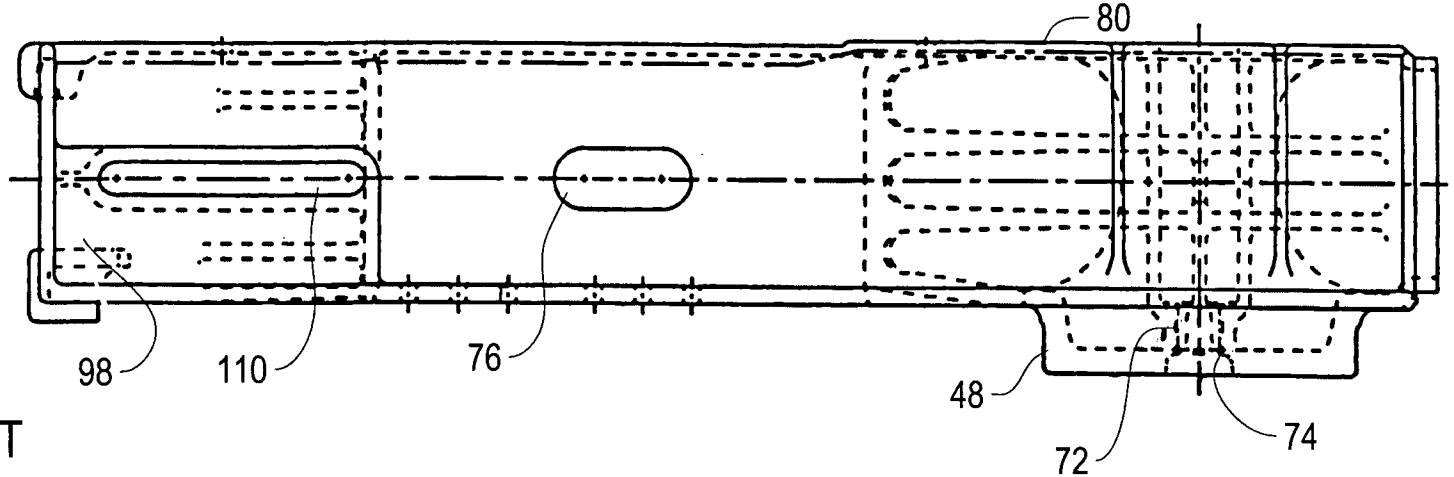
Fig. 5 PRIOR ART
Figure 6:
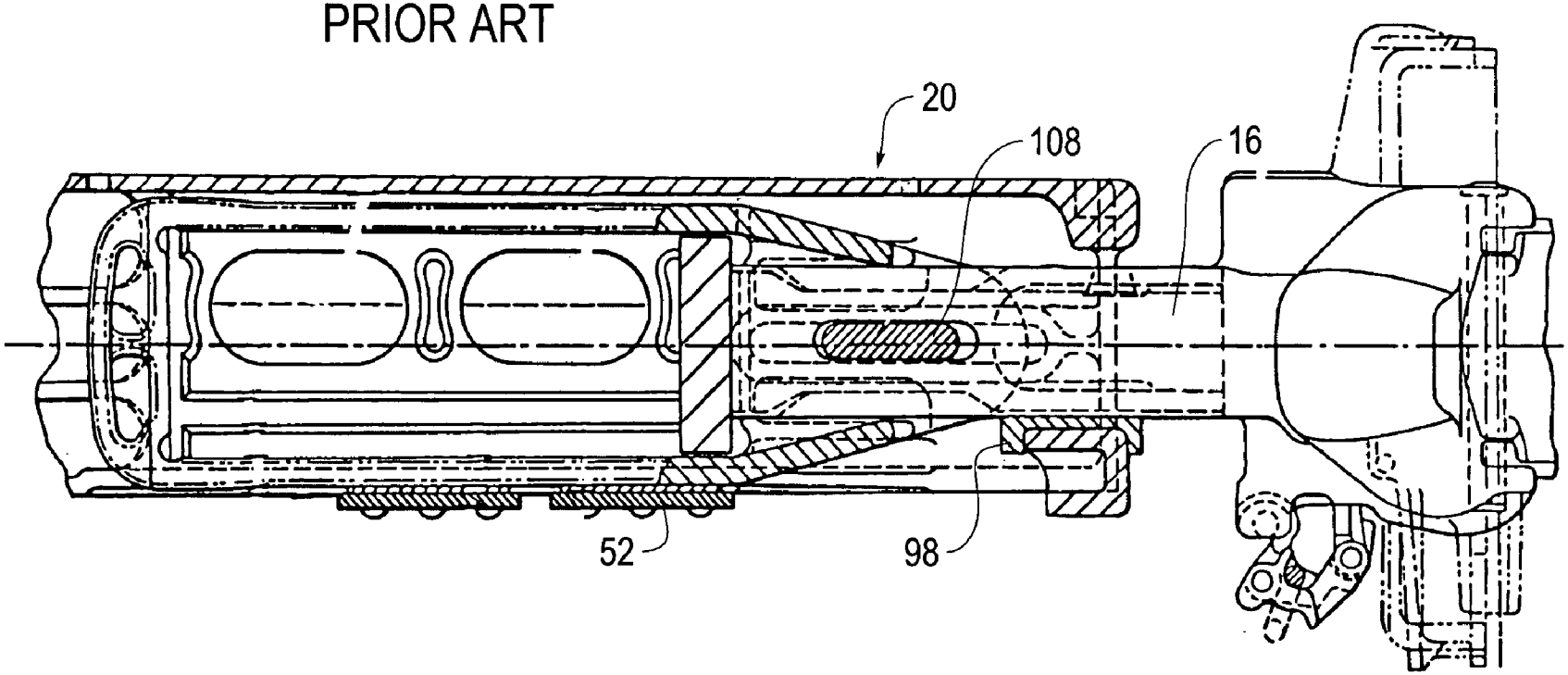
Fig. 6 PRIOR ART
FIG. 6 is a partial cross-section of the Type E draft sill end casting of FIGS. 4–5 showing a typical conventional Type E coupler received within and attached to the draft gear system housed within the end sill casting.
Figure 7:
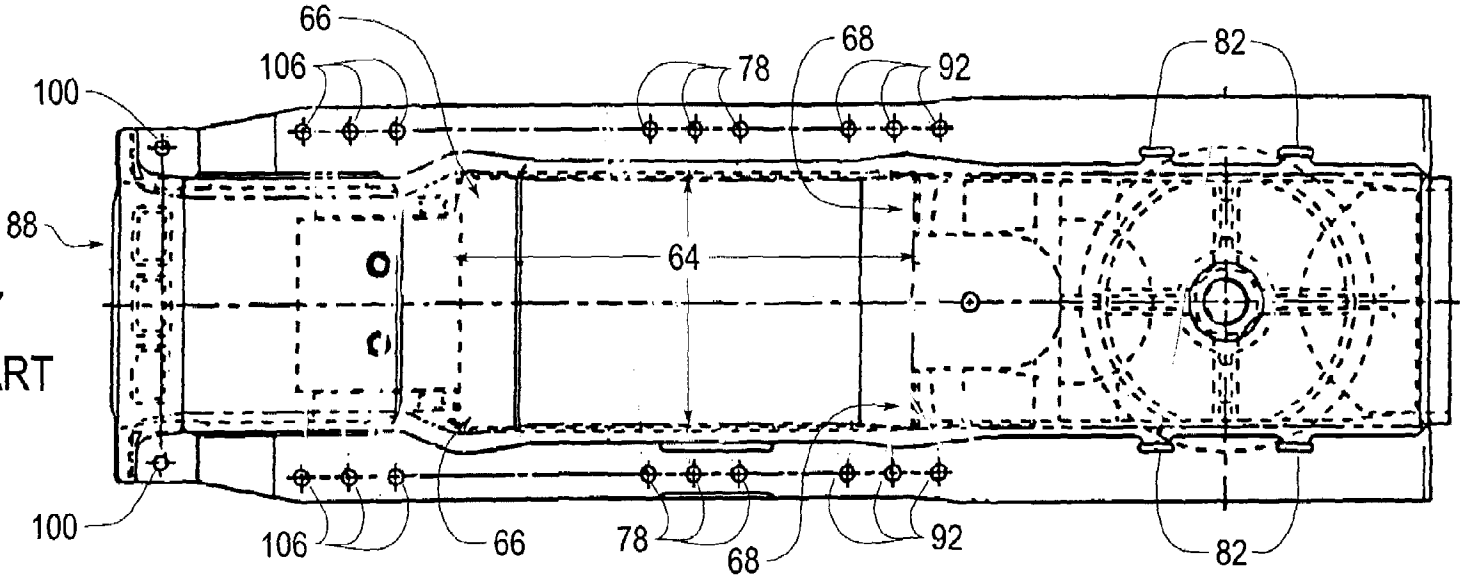
Fig. 7 PRIOR ART
FIGS. 7–8 are top and side views, respectively, of a typical prior art Type F draft sill end casting having an integral center plate.
Figure 8:
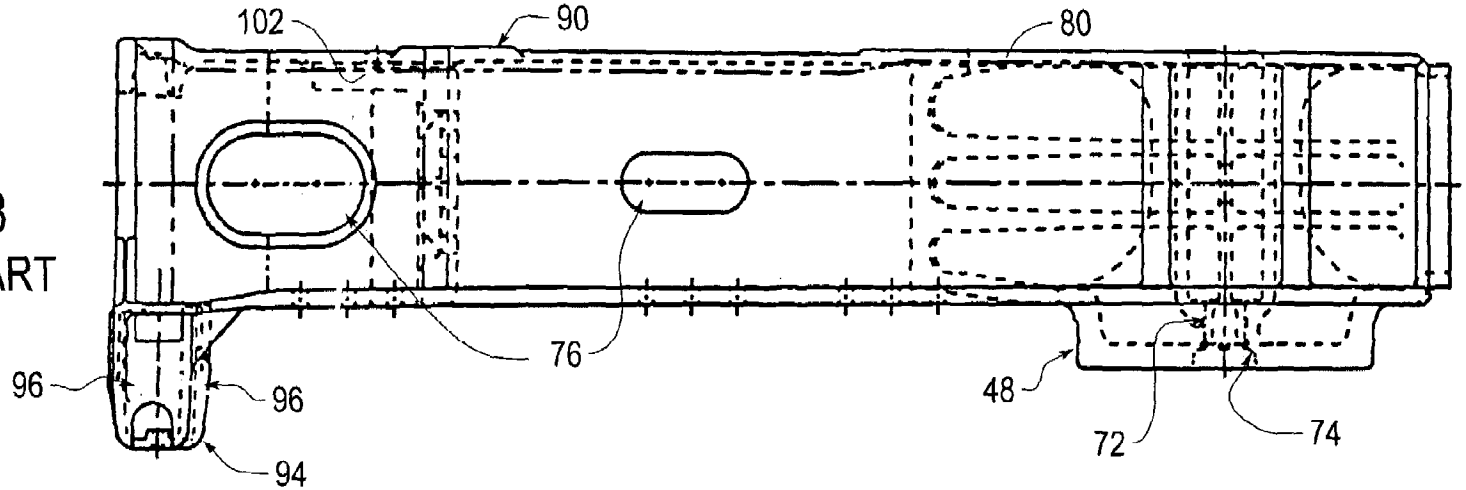
Fig. 8 PRIOR ART
Figure 9:
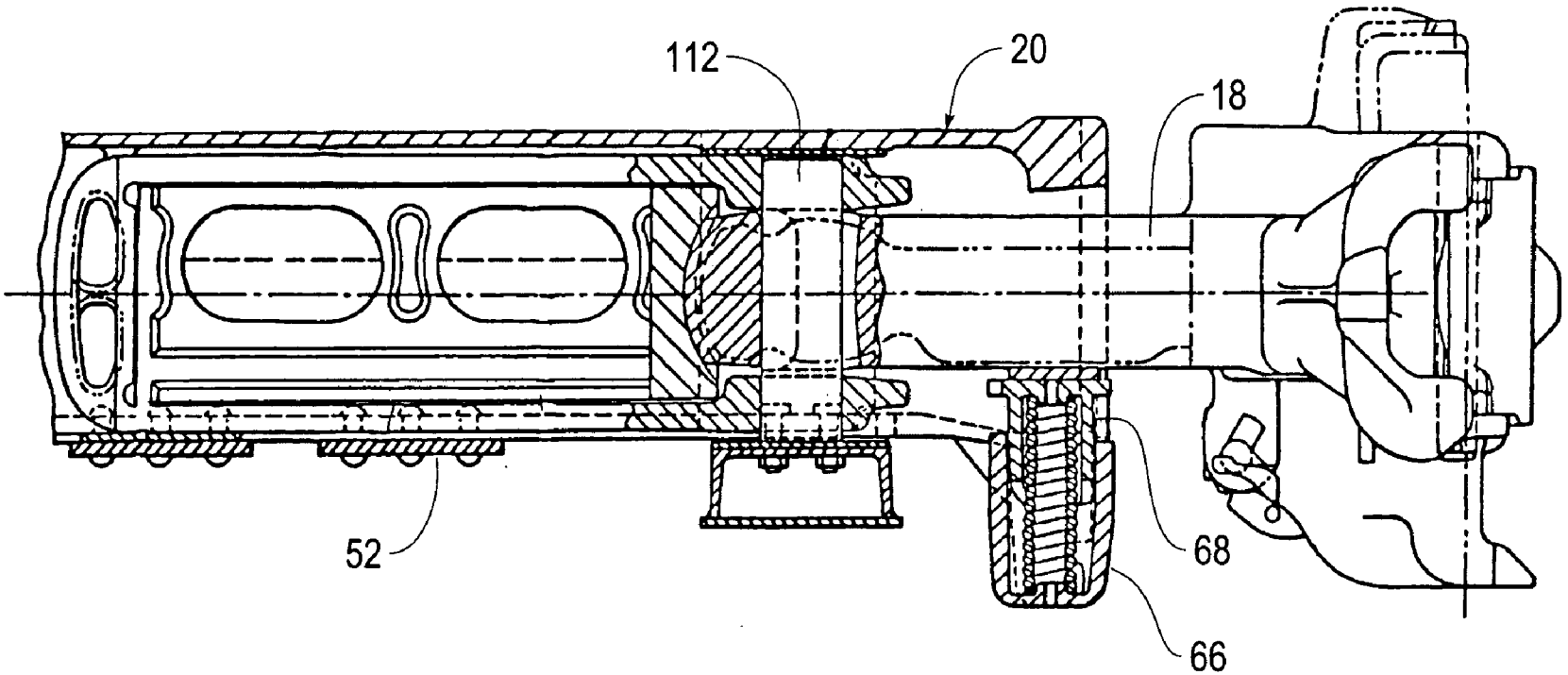
Fig. 9 PRIOR ART
FIG. 9 is a partial cross-section of the Type F draft sill end casting of FIGS. 7–8 showing a typical conventional Type F coupler received within and attached to the draft gear system housed within the end sill casting.
Figure 10:
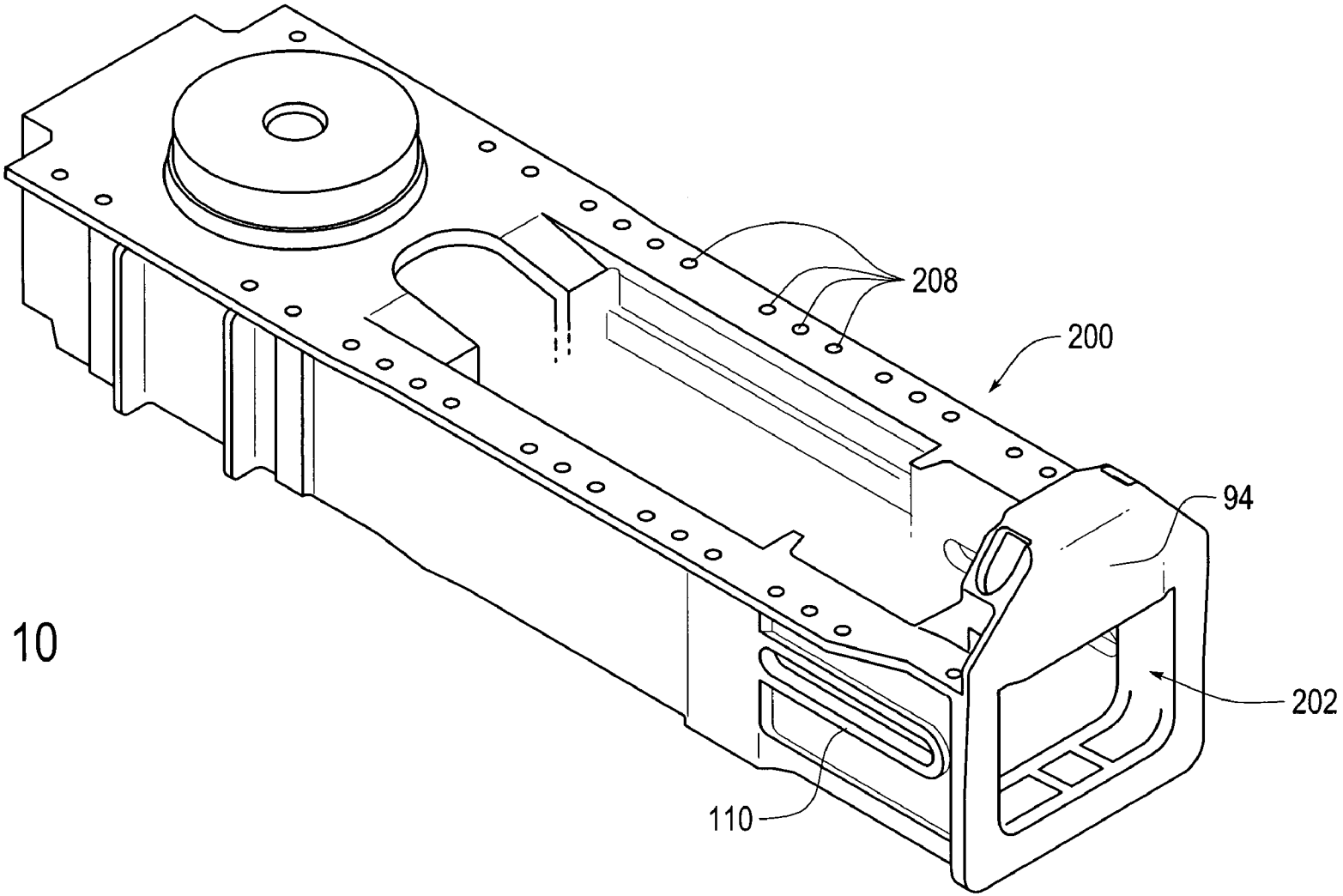
FIG. 10 is a bottom perspective view of an exemplary common draft end sill according to the invention that accommodates either Type E or Type F draft gears and couplers.
Figure 11:
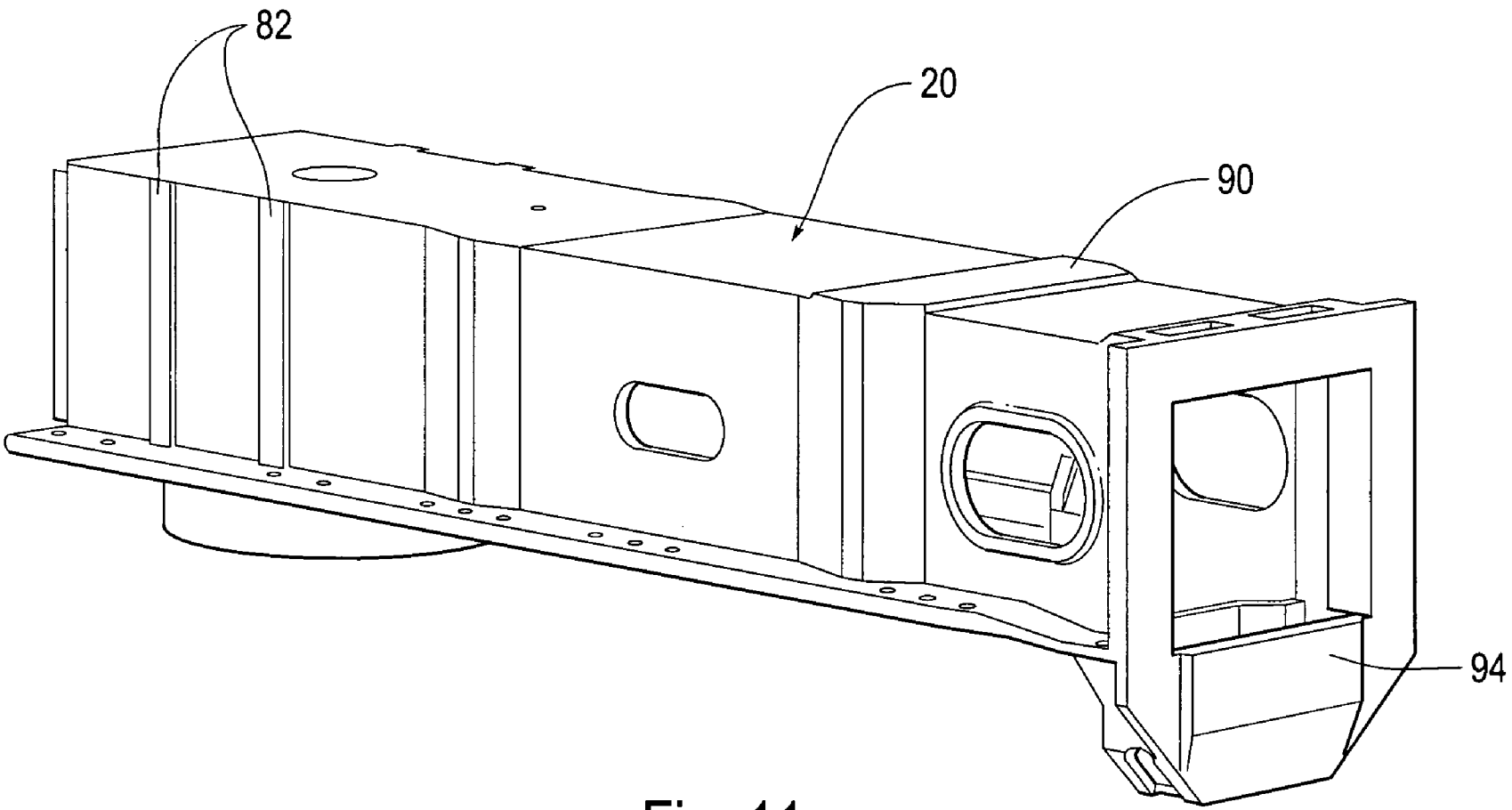
Fig. 11 PRIOR ART
FIG. 11 is a top perspective view of a typical Type F draft sill having a striker pad.
Figure 12A:
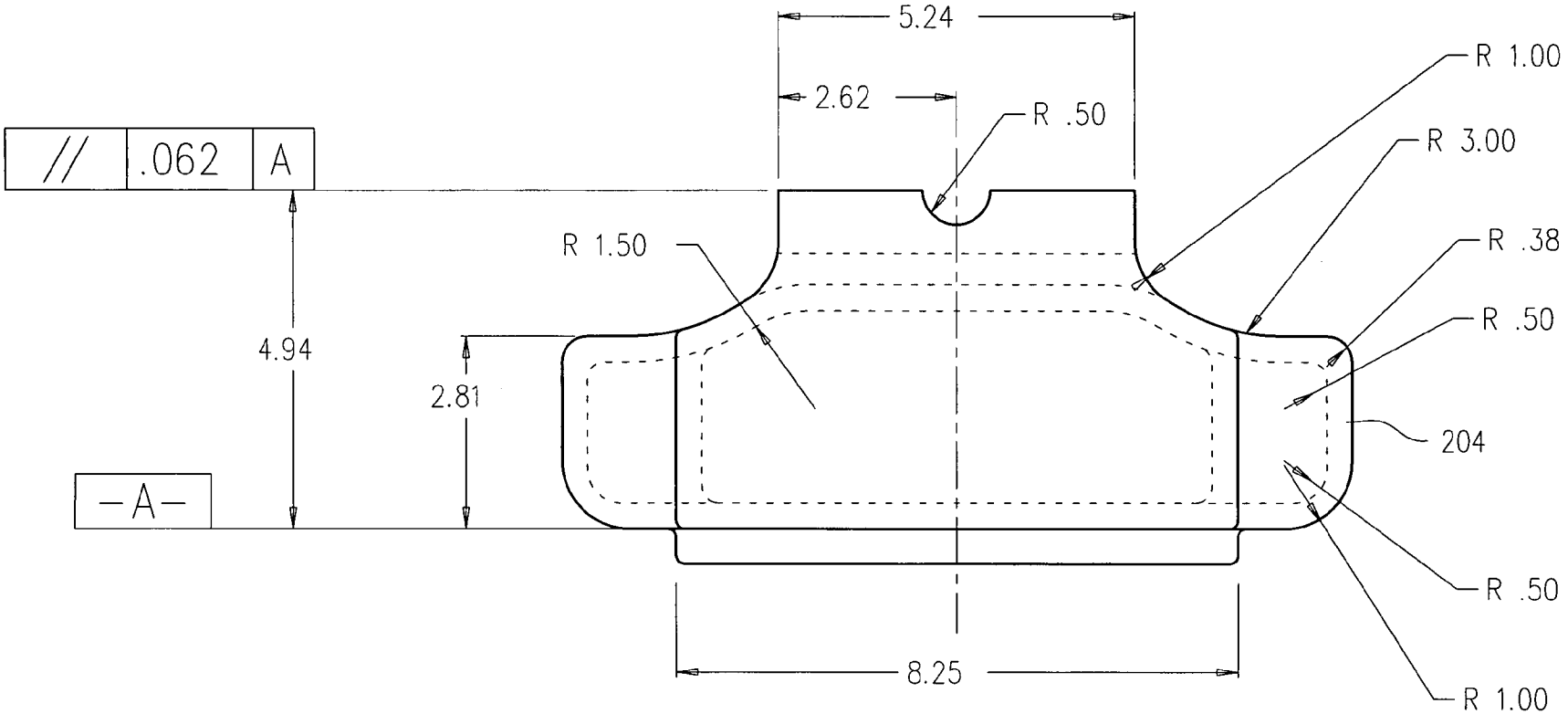
FIGS. 12A–B show bottom and side partial cutaway views, respectively, of an exemplary drop-in Type E coupler support according to the invention used to accommodate and support a Type E coupler.
Figure 12B:
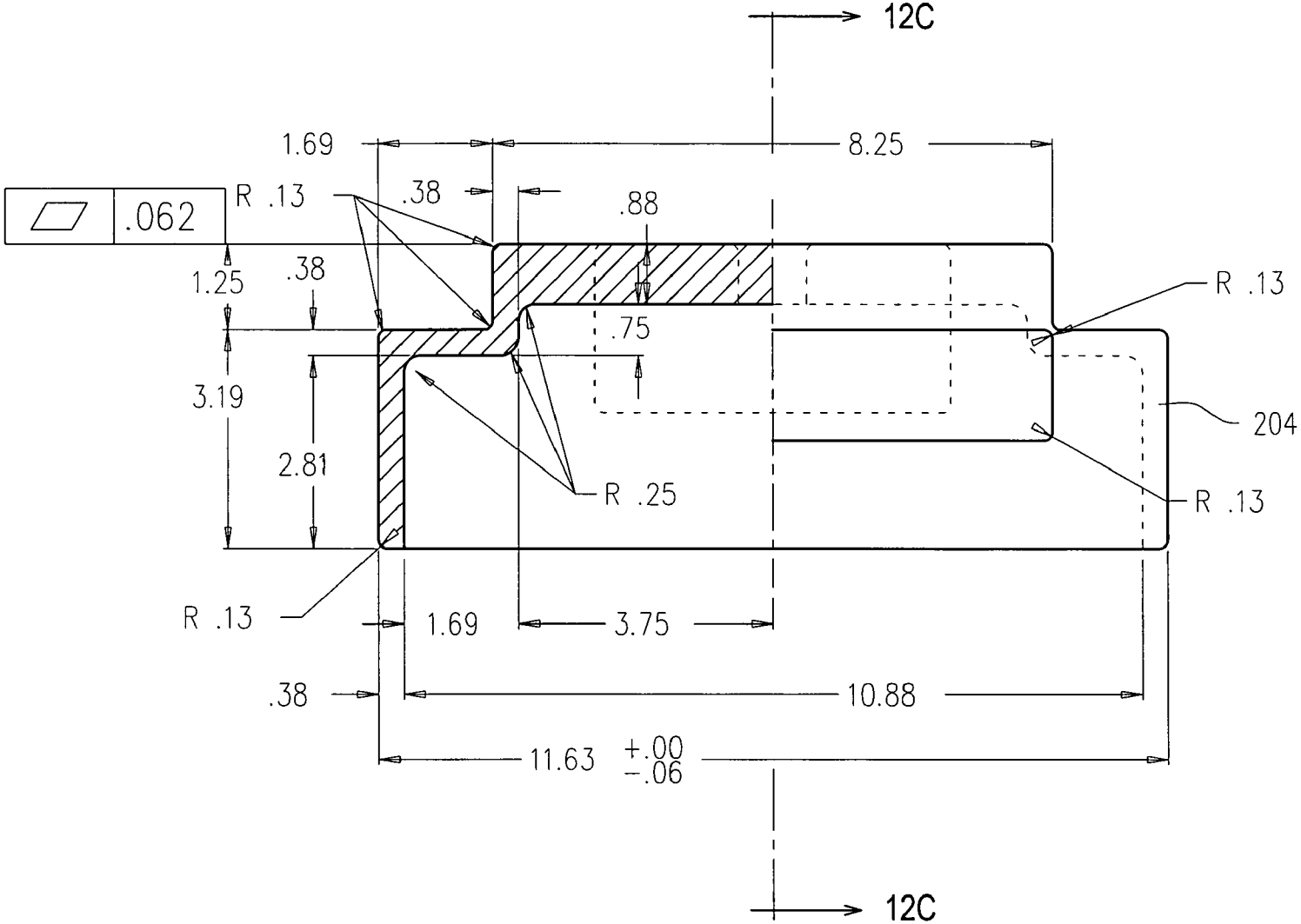
Figure 12C:
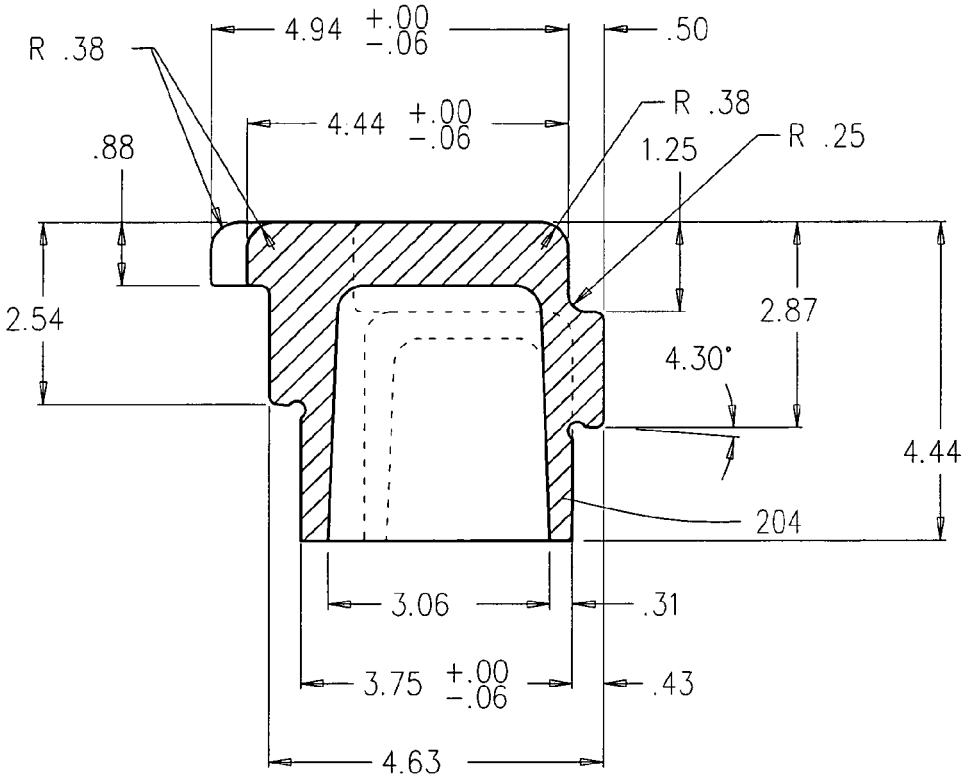
FIG. 12C is a sectional view of the drop-in Type E coupler support of FIG. 12B taken along lines A—A.
Figure 12D:
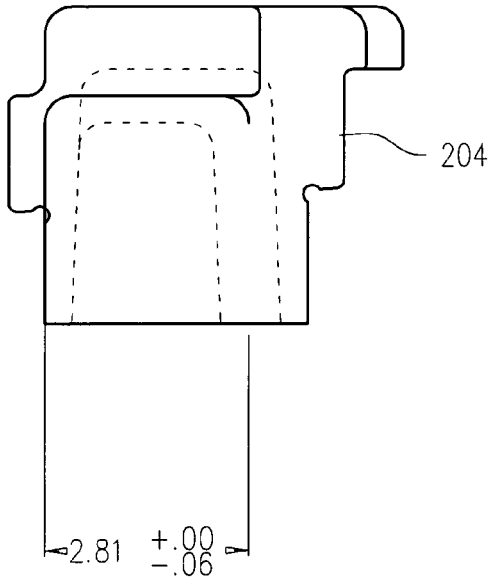
FIG. 12D is an end view of the drop-in Type E coupler support of FIG. 12A.

An exemplary common E/F cast draft sill 200 according to the invention is illustrated in FIGS. 10 and 12–16. Parts common to both Type E and Type F draft sills, such as those outlined with reference to FIGS. 4–9, may be retained even if not specifically referenced by like numerals. However, additional features are specifically provided assuring a common platform that can accept either Type E or Type F draft gears and couplers. As shown in FIG. 10, common E/F draft sill 200 incorporates an integral spring basket 94 for receiving a Type F coupler system as in a standard cast Type F draft sill, such as the one shown in FIG. 11. Common E/F draft sill 200 also incorporates a keyslot 110 as in a standard Type E draft sill. As such, a standard cross-key connection 108 may be used to attach a Type E draft coupler to the draft sill. Additionally, common E/F draft sill 200 can accept a standard vertical pin connection 112 so that Type F draft couplers can be attached. Cast common E/F draft sill 200 also includes a coupler opening 202 that accepts both Type E and F couplers. Additionally, it is preferable to provide flange holes 208 in a pattern that accepts all draft carrier combinations, rather than the previous use of holes that matched only a Type E or Type F carrier.

Figure 13:
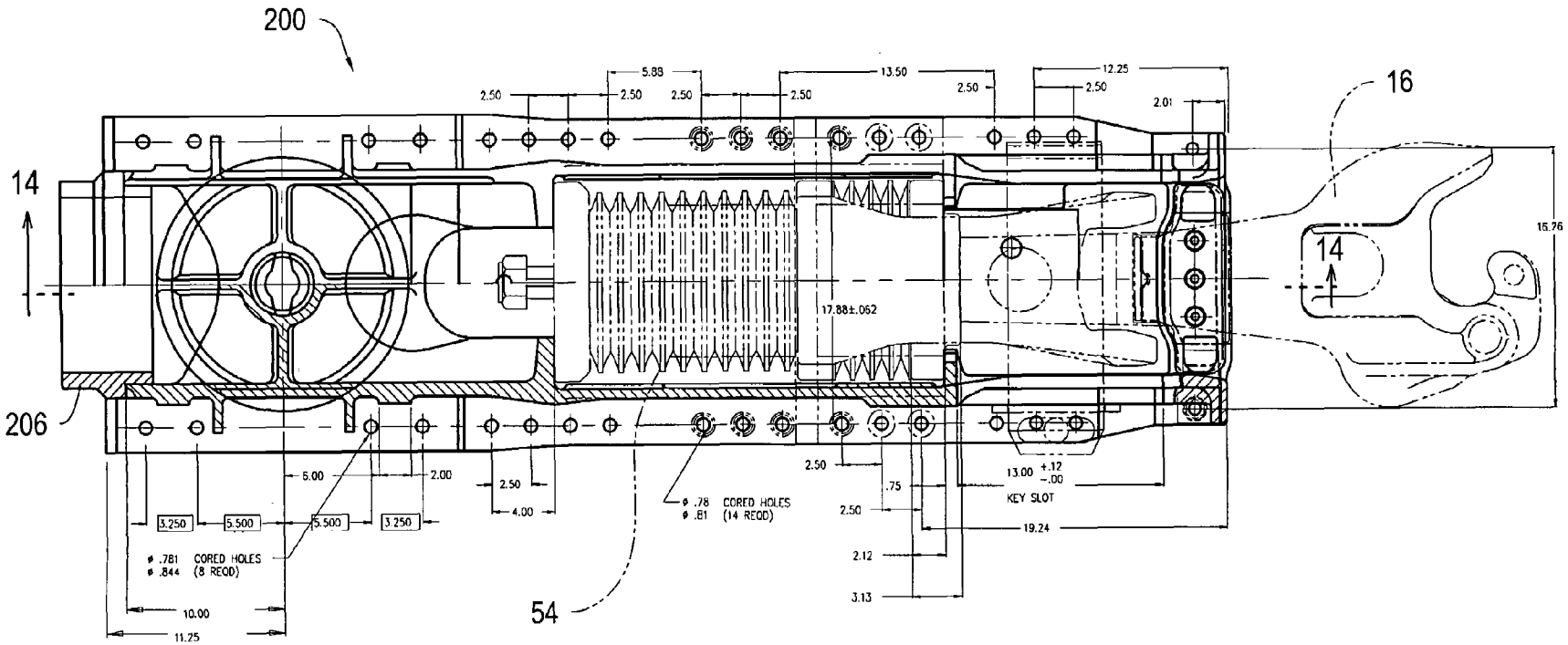
FIGS. 13–14 are cut-away top and side views of the common end sill casting of FIG. 10 showing a typical conventional Type E coupler received within and attached to the draft gear system housed within the end sill casting.
Figure 14:
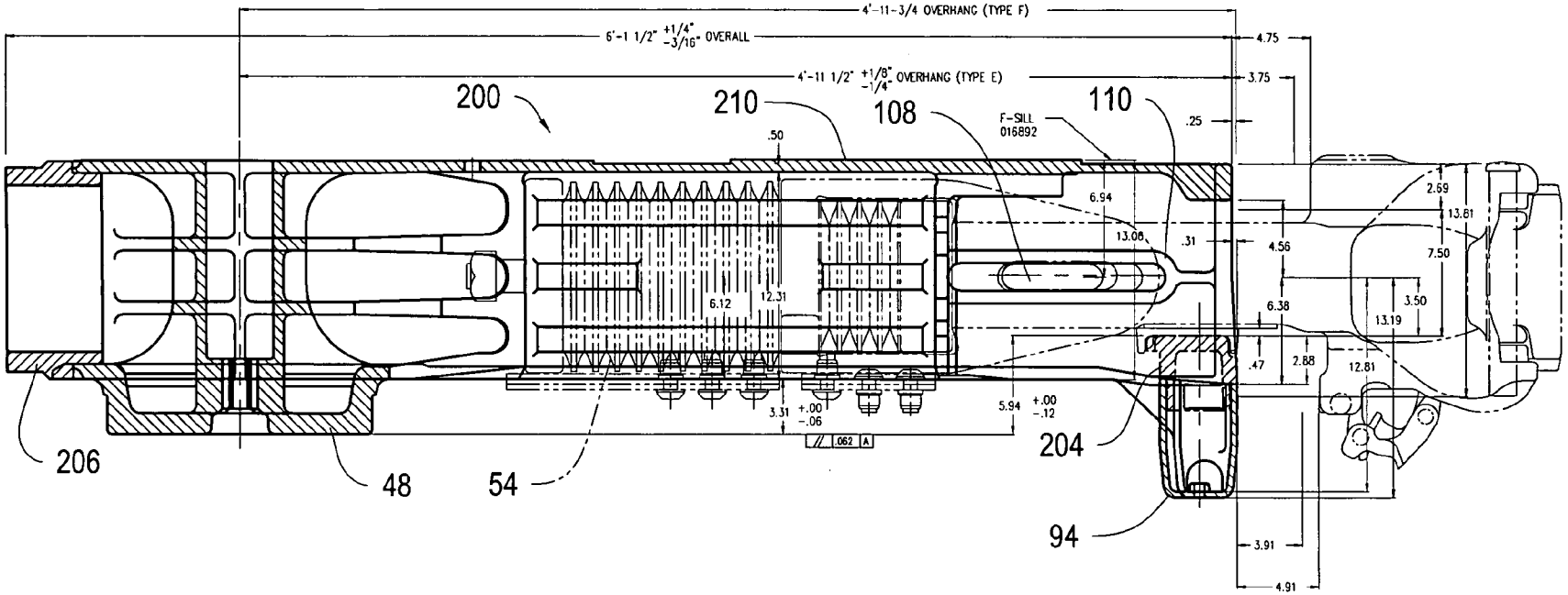

To adapt coupler opening 202 to properly support a Type E coupler, a special drop-in Type E coupler support 204 is provided that is substituted for the Type F coupler spring assembly typically found in a Type F application. That is, the Type F coupler spring assembly is removed and in its place drop-in Type E coupler support 204 is inserted as shown so that it abuts against support features of the integral spring basket 94. Once inserted, drop-in Type E coupler support 204 acts in place of the fixed coupler carrier 98 used in typical Type E applications to properly support a Type E draft coupler 16 as shown in FIGS. 12–14. Drop-in Type E coupler support 204 is preferably loosely (removably) located within the spring basket 94. Because drop-in Type E coupler support 204 is nicely cradled within spring basket 94 and prevented from removal during use once the Type E coupler gear is installed, there is no need to weld or otherwise affix the drop-in Type E coupler support to the draft sill. This allows for ready replacement should a change in configuration be necessary. Drop-in Type E coupler support may be provided with a top wear plate similar to that used in coupler carrier 98 in standard Type E type applications. While preferably loose fitted (i.e., not welded) with top shoulders that abut surfaces of the spring basket 94 and a bottom that freely extends above a lower surface of basket 94, drop-in coupler 204 may be extended in length so as to also engage the lower surface of basket 94. Other modifications are contemplated.

With this design, common E/F draft sill 200 is readily convertible to either Type E or Type F draft gear components and couplers with only simple changes. Type F couplers are supported in the traditional and industry standard way using the front end having a Type F spring basket and spring-biased support assembly and attached by the traditional vertical pin connection. Type E couplers are supported by replacing the spring-biased support assembly within spring basket 94 with drop-in Type E coupler support 202, which supports the Type E coupler substantially the same as the traditional and industry standard way and provides a fixed support surface at a desired position. Additionally, attachment of a Type E coupler is achieved by the traditional cross-key connection 108 using the keyslot 110 of the common E/F draft sill. Accordingly, common E/F draft sill 200 can replace the need for separate Type E and Type F draft sills and separate Type E and Type F draft sill molds.

Other opportunities to standardize the draft sill can be provided, further reducing the number of draft sill tooling needed to accommodate railway car options desired by various carbuilders. Carbuilders typically attach the car body and frame to the draft sill in three locations, the end sill on a top surface, at body bolster attachment areas on the sides of the draft sill, and to the center sill at the end facing the center sill. Carbuilder preferences and car types dictate the size and location of such attachment points. In the past, these three areas of attachment were custom designed for a particular application. This resulted in a large number of specialized tooling, essentially one set of tooling to produce the required molds for each different configuration. However, it has been found that certain features can be standardized to accommodate a broader array of applications from use of the same common E/F draft sill using a single set of tooling.

As mentioned above, one attachment location is to the end sill. This is achieved by providing a machined area on the top of the cast draft sill near the coupler opening. Machining is needed to precisely locate and form the attachment surface for mounting. In current designs, carbuilder preferences and car types dictate the location and size of the machined area. For each different design, the size of the machined area is typically no larger than required for the attachment surface, with the location dictated by the carbuilder. Thus, up to now, each cast draft sill had a particular machined area (such as striker pad 90 in FIG. 11) for a particular application. However, by increasing the machined area, it is possible to provide a "one size fits all" standardized end sill reference feature 210 that can accommodate a plurality of different carbuilder preferences and car types. That is, the machined area is increased to extend over several discrete prior known attachment areas of specified size and location so that the one common machined pad will adapt to attachment of any of a plurality of car types. The feature 210 will have an increased surface area, such as that shown in FIG. 14, or may extend across the entire top surface. That is, the whole top surface may be machined to a predetermined height from a reference plane so as to accommodate attachment to many different car types. Although this may require additional machining, it enables one casting to accommodate more variations.

Figure 15:
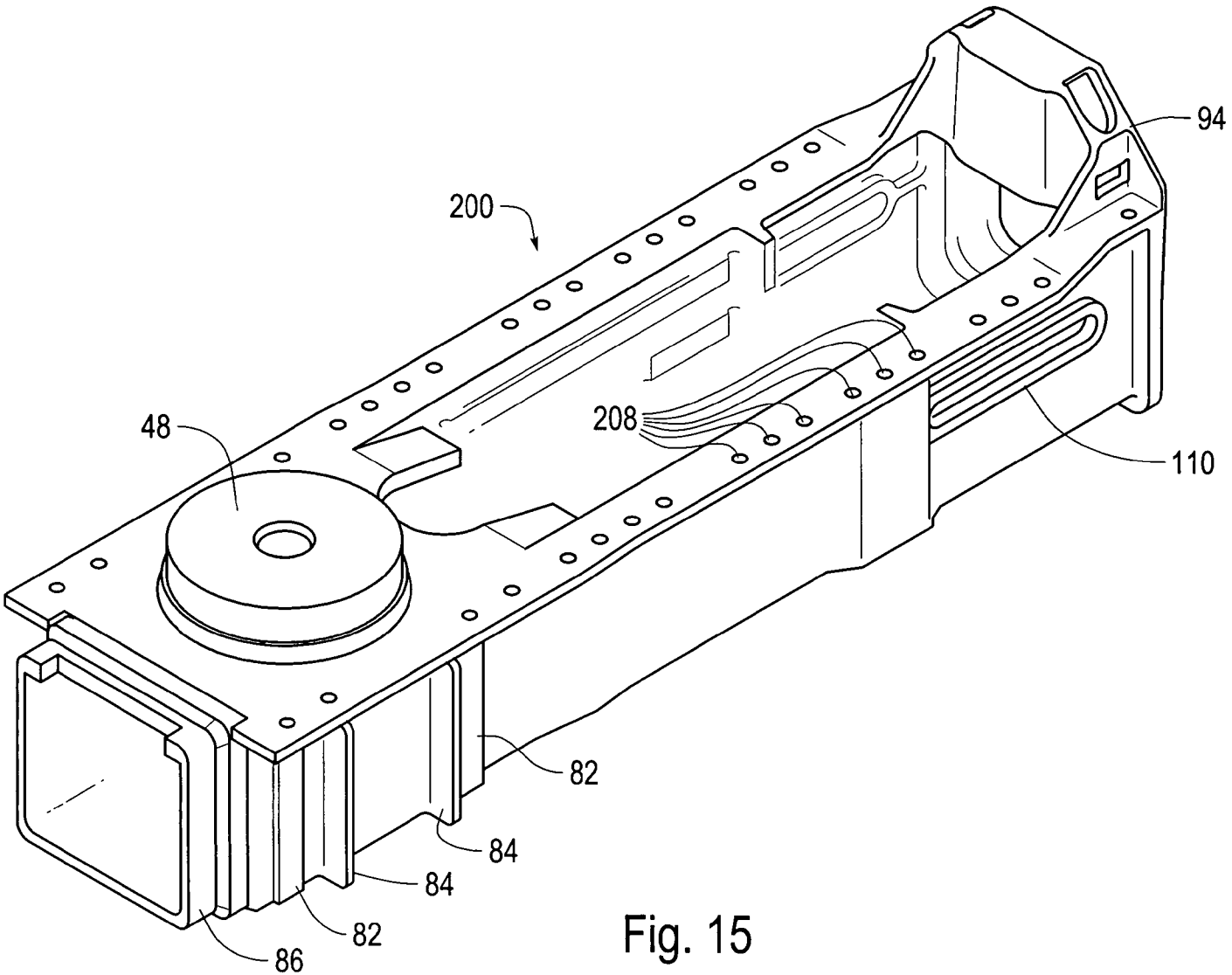
FIG. 15 is a bottom perspective view of an exemplary common draft end sill according to the invention showing pad and wing structures.
Figure 16:
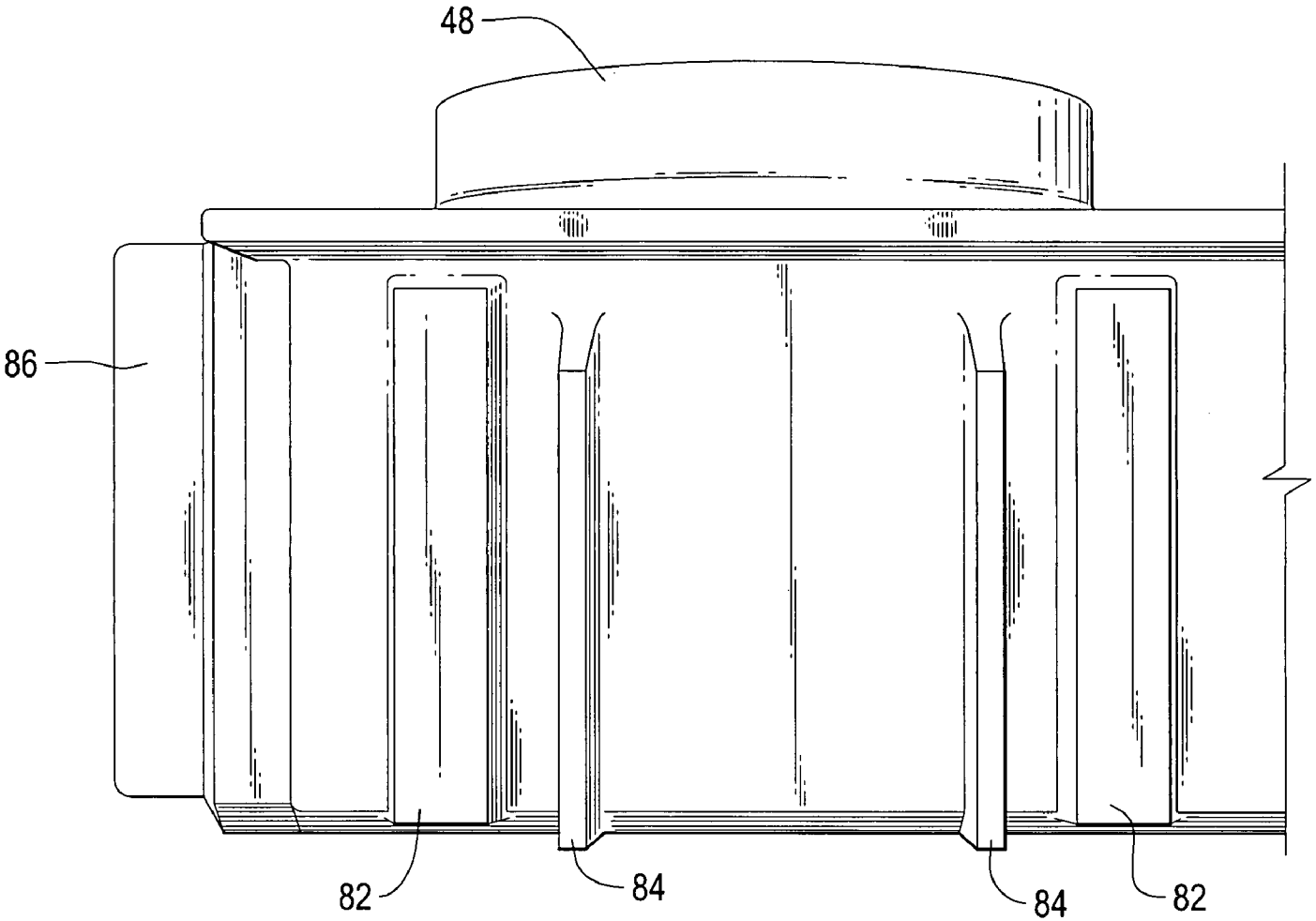
FIG. 16 is a partial side view of FIG. 15 better illustrating the pad and wing structures.

The second attachment area is where the car body bolster attaches to the draft sill. This structural element is welded to the sides of the draft sill and centered about the center plate. At present, there are two primary preferences for this connection. Some carbuilders prefer raised pads, such as body bolster pads 82 shown in FIG. 7, which are machined and located to provide a proper reference surface to attach the bolster to, such as by welding. Other carbuilders prefer "wings", such as the body bolster wings 84 shown in FIG. 4, which provide both an alignment reference surface and a surface to attach the bolster to. It has been found that further standardization can be achieved with the inventive common E/F draft sill by providing both the body bolster pad 82 and body bolster wing 84 features on all cast common E/F draft sills 200 as shown in FIGS. 15 and 16. This further reduces the number of separate draft sills necessary while accommodating various carbuilder specifications and preferences as to attachment points.

Figure 17:
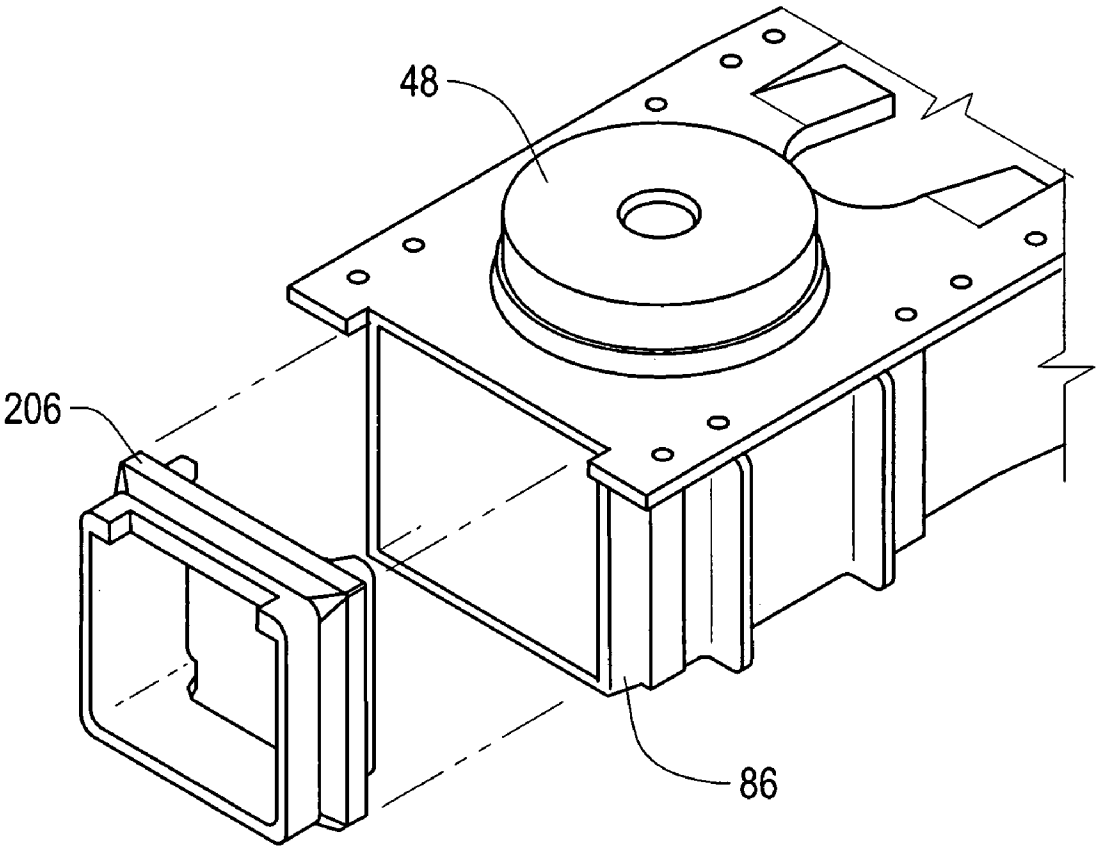
FIG. 17 is a partial side view of an exemplary common end sill casting according to the invention and an exemplary weld-in plug that adapts the common draft end sill to a particular railroad car configuration.
Figure 18:
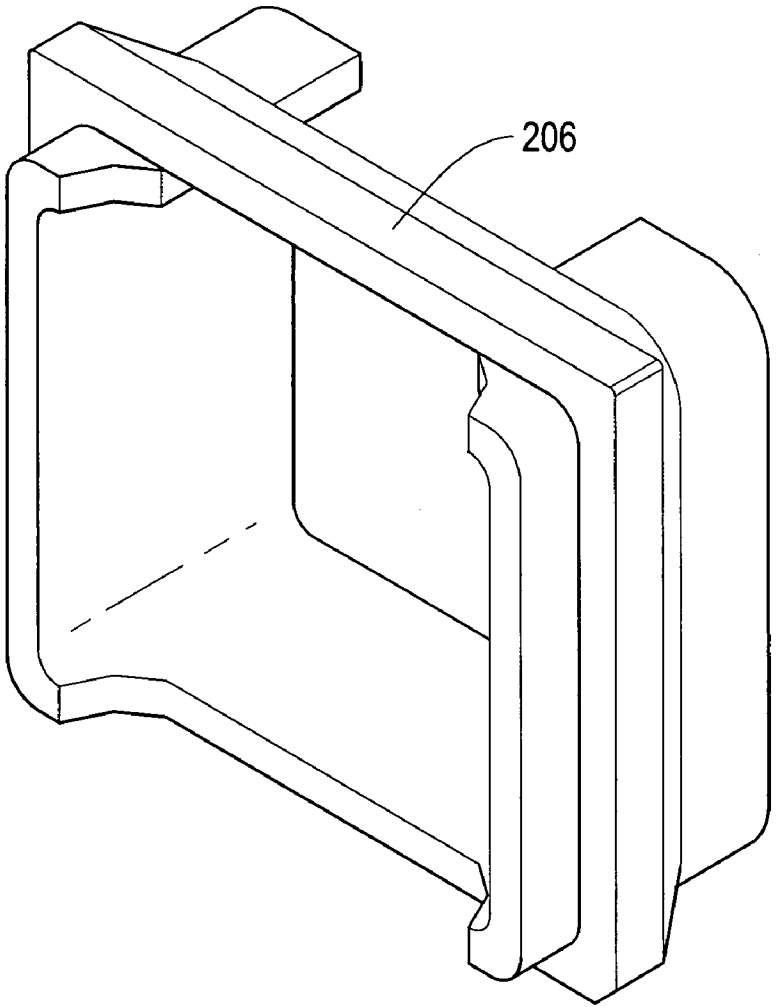
FIG. 18 is a perspective view of the exemplary weld-in plug of FIG. 17.
Figure 19:
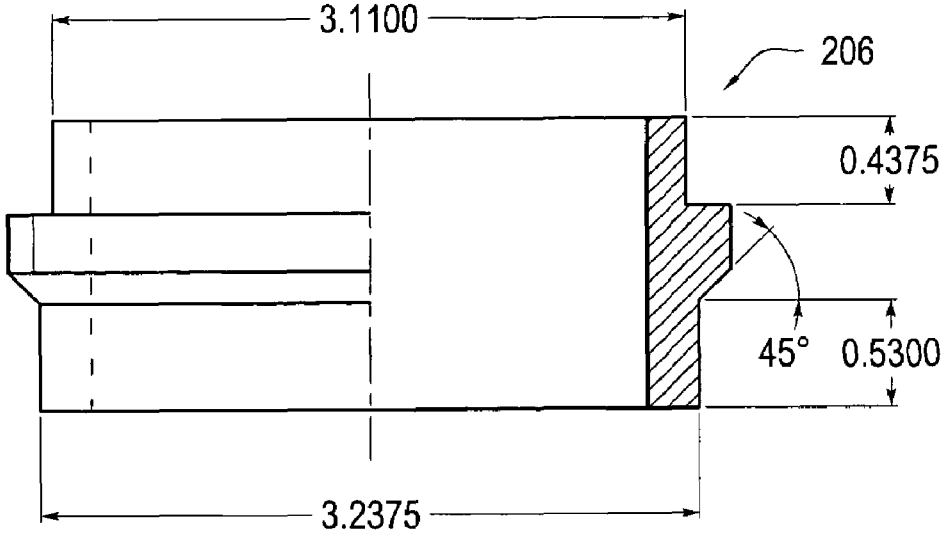
FIGS. 19–21 are side partial cutaway, end and cross-sectional views, respectively, of the weld-in plug of FIG. 17.
Figure 20:
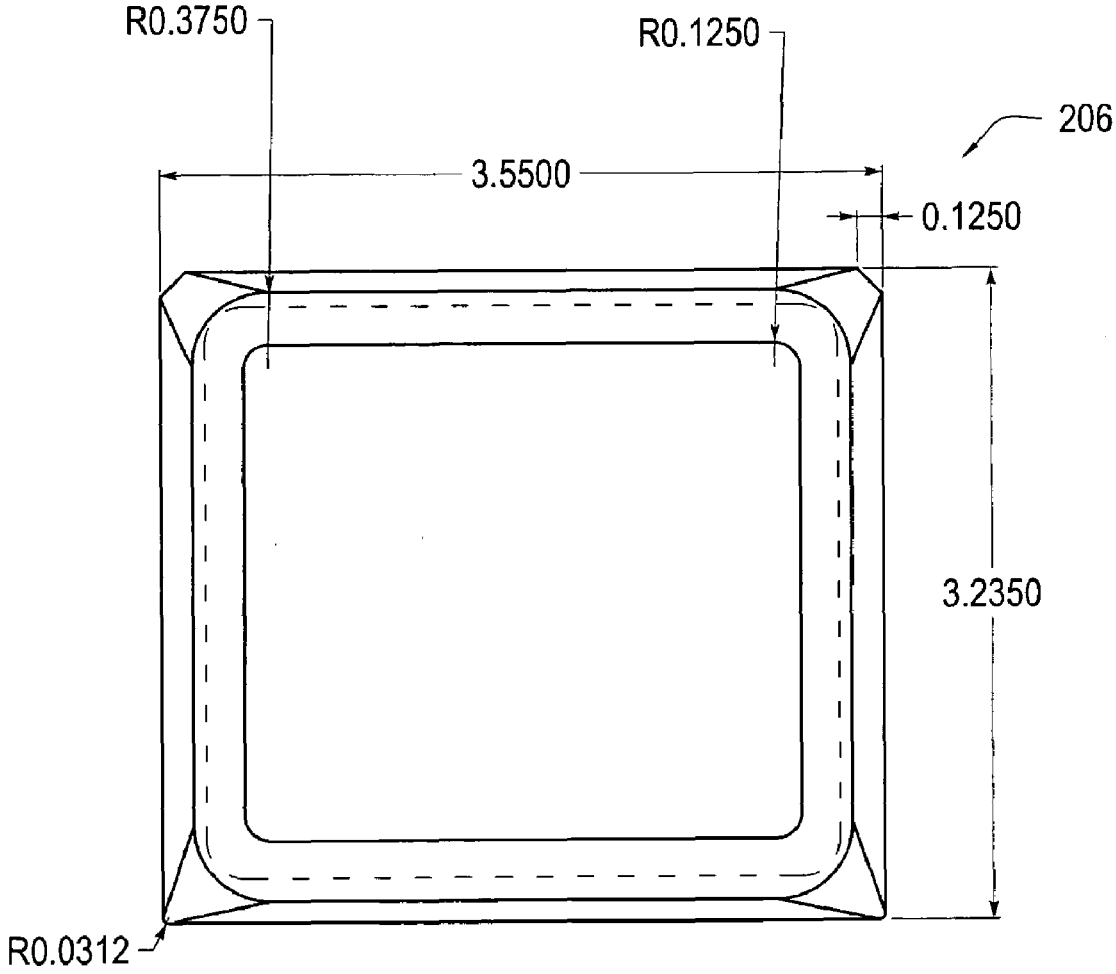
Figure 21:
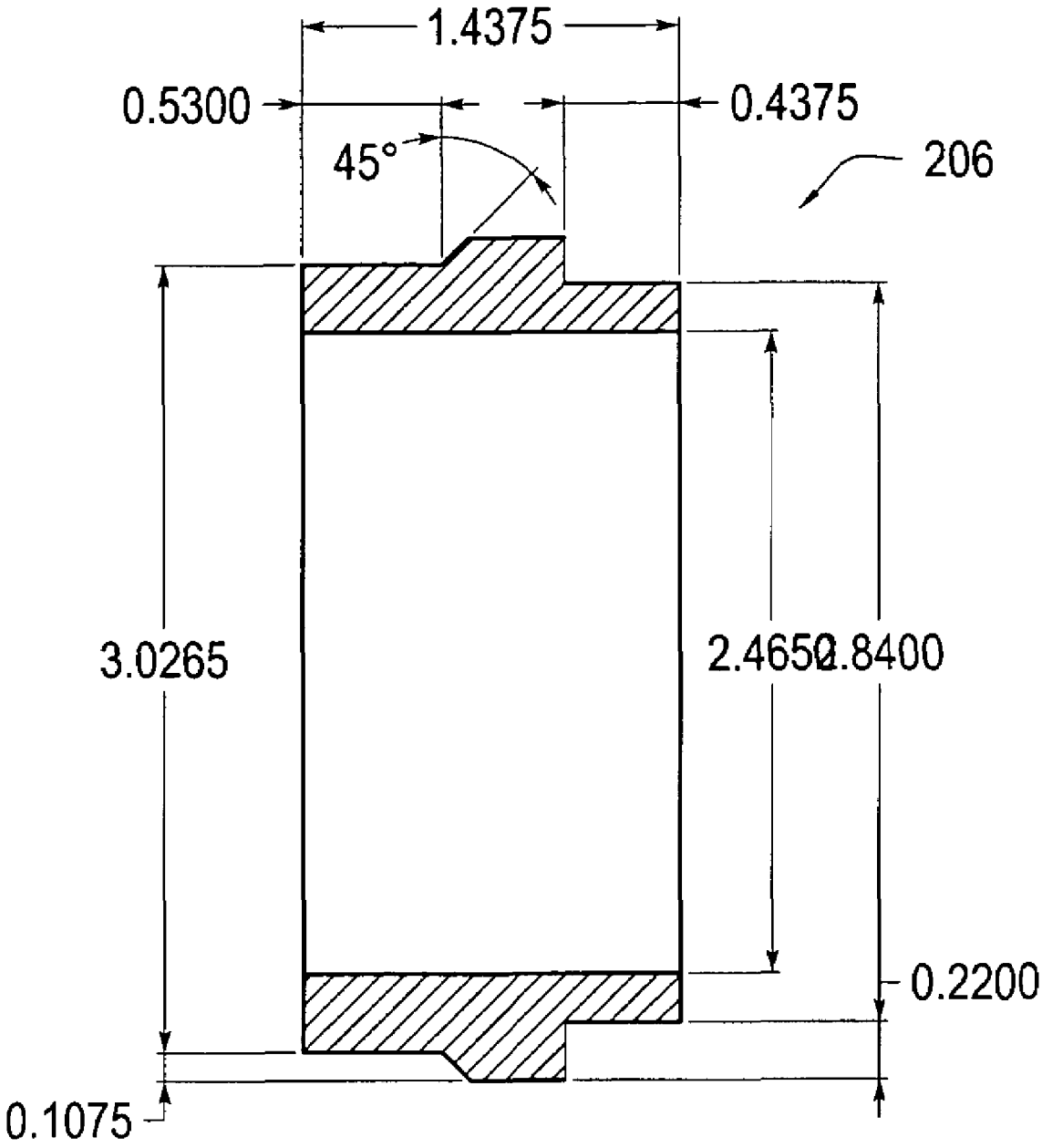

The third attachment area is where the center sill attaches to the draft sill. Again, depending on the car type and carbuilder preference, connection details vary. At present, numerous different tooling is necessary to accommodate all carbuilder orders. However, it has been found desirable to provide a single common E/F draft sill that can accommodate as many variations as possible. Because the necessary draft sill lengths and end configurations vary greatly depending on application, this standardization was first believed difficult to achieve. However, it was discovered that a "standardized" sill with a separate telescoping surface 86 to be attached to the sill, can be provided. This standardized end as best shown in FIG. 15 makes the total length of common E/F draft sill 200 slightly less than needed for most applications (or can be exactly the right length and configuration for the shortest application). To accommodate attachment to the center sill of a particular configuration, one of a series of weld-in "plugs" 206 is cast or fabricated as shown in FIG. 18. This "plug" 206 is customer specific for the necessary connection dimensions and features and can be readily inserted into sill attachment telescoping surface 86 as illustrated in FIG. 17 and fixed in place, such as by J-welding or other conventional welding or attachment techniques. For some applications, it is also possible to directly attach the draft sill to the center sill using sill attachment telescoping surface 86 without a plug (i.e., the shortest application).

By use of the weld-in plugs, a "plug-n-receiver" combination achieves wide application using only a single standardized cast common E/F draft sill 200 and none or one of a small set of specific weld-in plugs 206. While there may be a small finite number of plug designs required to accommodate various design applications, the small physical size of the plugs relative to the large size of the draft sills lend themselves to be easily manufactured.

This plug-n-receiver design also improves supply chain management and customer lead times by being able to make standardized common draft sills 200 even before orders or specifications are finalized, with only the need for minor assembly of a specified plug 206 or the casting of a small specialized plug once customer orders and specifications have been finalized. This also greatly reduces the parts inventory needed, since the common E/F draft sill will fit multiple current or future applications.

While only specific embodiments of the invention have been described and shown, it is apparent that various alternatives and modifications can be made thereto. Those skilled in the art will also recognize that certain additions can be made in these illustrative embodiments. It is, therefore, the intention in the appended claims to cover all such alternatives, modifications and additions as may fall within the true scope of the invention.

What is claimed is:

1. A common E/F draft sill assembly for connecting one railroad car to another that is capable of receiving Type E or Type F draft gears and couplers, comprising:

a draft sill main body including two side walls, a top wall, a bottom wall, a front end face and a rear end face;

a coupler opening on the front end face sized to accept both Type E and Type F draft gears and couplers;

flange holes provided in the bottom wall in a pattern that accepts both Type E and Type F draft carrier bolt configurations;

an integral spring basket assembly extending downward from the coupler opening on the front end face that is sized and shaped to receive a Type F spring-biased support assembly;

a keyslot provided on each of the two main body side walls near the front end face that is capable of receiving a cross-key connection of a Type E draft gear and coupler;

a mounting structure that accepts a standard vertical pin connection of a Type F draft gear and coupler; and a drop-in removable Type E coupler support that is removably fittable within the integral spring basket and serves as a fixed lower carrier surface for rigidly supporting a Type E draft gear and coupler.

2. The common E/F draft sill assembly of claim 1, wherein the drop-in removable Type E coupler support has shoulders that abut corresponding support surfaces of the integral spring basket support assembly to rigidly support the coupler support at a predetermined vertical position.

3. The common E/F draft sill assembly of claim 2, wherein the carrier surface of the drop-in removable Type E coupler support has a top wear plate affixed thereto.

4. The common E/F draft sill assembly of claim 1, wherein the carrier surface of the drop-in removable Type E coupler support has a top wear plate affixed thereto.

5. The common E/F draft sill assembly of claim 1, wherein the drop-in Type E coupler support is loosely fitted in the integral spring basket assembly.

6. The common E/F draft sill assembly of claim 1, wherein the side walls are each provided with at least one of body bolster pads and body bolster wings to provide mounting surfaces for attachment of a railroad car body bolster.

7. The common E/F draft sill assembly of claim 6, wherein the side walls are provided with both body bolster pads and body bolster wings.

8. The common E/F draft sill assembly of claim 7, wherein the body bolster pads and body bolster wings are alternatively provided on the side walls.

9. The common E/F draft sill assembly of claim 1, wherein the main body is cast and the top wall includes a precisely machined attachment surface near the coupler opening that extends across an enlarged surface area that encompasses at least two discrete attachment areas for mounting of the draft sill to two different types of railroad car bodies.

10. The common E/F draft sill assembly of claim 9, wherein substantially the entire top wall is precisely machined.

11. The common E/F draft sill assembly of claim 1, wherein the main body is a standardized draft sill having a total length from the front face to the rear face sized to accommodate multiple railroad car configurations.

12. The common E/F draft sill assembly of claim 11, wherein the rear end face of the main body is sized and shaped to fit a center sill of a first railroad car configuration.

13. The common E/F draft sill assembly of claim 12, further comprising a weld-in plug mountable on the rear end face of the standardized main body, the weld-in plug having a length and rear face shape that adapts the standardized main body of the draft sill to a center sill of a second railroad car configuration different from the first railroad car configuration.

14. The common E/F draft sill assembly of claim 11, further comprising at least two different weld-in plugs mountable on the rear end face of the standardized main body, each different weld-in plug having a length and rear face shape that adapts the standardized main body of the draft sill to a center sill of a different railroad car configuration.

15. The common E/F draft sill assembly of claim 11, further comprising a weld-in plug mounted on the rear end face of the standardized main body, the weld-in plug having a length and rear face shape that adapts the standardized main body of the draft sill to a center sill of a specific railroad car configuration.

16. The common E/F draft sill assembly of claim 1, further comprising a Type F spring-biased support assembly within the integral spring basket assembly.

17. A common E/F draft sill assembly for connecting one railroad car to another that is capable of receiving Type E or Type F draft gears and couplers, comprising:

a draft sill main body including two side walls, a top wall, a bottom wall, a front end face and a rear end face;

a coupler opening on the front end face sized to accept both Type E and Type F draft gears and couplers;

flange holes provided in the bottom wall in a pattern that accepts both Type E and Type F draft carrier bolt configurations;

an integral spring basket assembly extending downward from the coupler opening on the front end face that is sized and shaped to receive a Type F spring-biased support assembly;

a keyslot provided on each of the two main body side walls near the front end face that is capable of receiving a cross-key connection of a Type E draft gear and coupler;

a mounting structure that accepts a standard vertical pin connection of a Type F draft gear and coupler;

a drop-in removable Type E coupler support that is removably fittable within the integral spring basket and serves as a fixed lower carrier surface for rigidly supporting a Type E draft gear and coupler;

body bolster pads and body bolster wings provided on the side walls;

the main body is a standardized cast draft sill having a total length from the front face to the rear face sized to accommodate multiple railroad car configurations and the top wall includes a precisely machined attachment surface near the coupler opening that extends across an enlarged surface area that encompasses at least two discrete attachment areas for mounting of the draft sill to two different types of railroad car bodies; and a weld-in plug mounted on the rear end face of the standardized main body, the weld-in plug having a length and rear face shape that adapts the standardized main body of the draft sill to a center sill of a specific railroad car configuration.

18. A common E/F draft sill assembly for connecting one railroad car to another that is capable of receiving Type E or Type F draft gears and couplers, comprising:

a draft sill main body including two side walls, a top wall, a bottom wall, a front end face and a rear end face;

a coupler opening on the front end face sized to accept both Type E and Type F draft gears and couplers;

flange holes provided in the bottom wall in a pattern that accepts both Type E and Type F draft carrier bolt configurations;

an integral spring basket assembly extending downward from the coupler opening on the front end face that is sized and shaped to receive a Type F spring-biased support assembly;

a keyslot provided on each of the two main body side walls near the front end face that is capable of receiving a cross-key connection of a Type E draft gear and coupler;

a mounting structure that accepts a standard vertical pin connection of a Type F draft gear and coupler;

a drop-in removable Type E coupler support that is removably fittable within the integral spring basket and serves as a fixed lower carrier surface for rigidly supporting a Type E draft gear and coupler;

body bolster pads and body bolster wings provided on the side walls;

the main body is a standardized draft sill having a total length from the front face to the rear face sized to accommodate multiple railroad car configurations; and a weld-in plug mounted on the rear end face of the standardized main body, the weld-in plug having a length and rear face shape that adapts the standardized main body of the draft sill to a center sill of a specific railroad car configuration.

19. A common E/F draft sill assembly for connecting one railroad car to another that is capable of receiving Type E or Type F draft gears and couplers, comprising:

a draft sill main body including two side walls, a top wall, a bottom wall, a front end face and a rear end face;

a coupler opening on the front end face sized to accept both Type E and Type F draft gears and couplers;

flange holes provided in the bottom wall in a pattern that accepts both Type E and Type F draft carrier bolt configurations;

an integral spring basket assembly extending downward from the coupler opening on the front end face that is sized and shaped to receive a Type F spring-biased support assembly;

a keyslot provided on each of the two main body side walls near the front end face that is capable of receiving a cross-key connection of a Type E draft gear and coupler;

a mounting structure that accepts a standard vertical pin connection of a Type F draft gear and coupler;

a drop-in removable Type E coupler support that is removably fittable within the integral spring basket and serves as a fixed lower carrier surface for rigidly supporting a Type E draft gear and coupler;

body bolster pads and body bolster wings provided on the side walls; and the main body is a standardized cast draft sill having a total length from the front face to the rear face sized to accommodate multiple railroad car configurations and the top wall includes a precisely machined attachment surface near the coupler opening that extends across an enlarged surface area that encompasses at least two discrete attachment areas for mounting of the draft sill to two different types of railroad car bodies, wherein the rear end face of the main body is sized and shaped to fit a center sill of a first railroad car configuration and a weld-in plug mountable on the rear end face of the standardized main body has a length and rear face shape that adapts the standardized main body of the draft sill to a center sill of a second railroad car configuration different from the first railroad car configuration.

20. A common E/F draft sill assembly for connecting one railroad car to another that is capable of receiving Type E or Type F draft gears and couplers, comprising:

a draft sill main body including two side walls, a top wall, a bottom wall, a front end face and a rear end face;

a coupler opening on the front end face sized to accept both Type E and Type F draft gears and couplers;

flange holes provided in the bottom wall in a pattern that accepts both Type E and Type F draft carrier bolt configurations;

an integral spring basket assembly extending downward from the coupler opening on the front end face that is sized and shaped to receive a Type F spring-biased support assembly;

a keyslot provided on each of the two main body side walls near the front end face that is capable of receiving a cross-key connection of a Type E draft gear and coupler;

a mounting structure that accepts a standard vertical pin connection of a Type F draft gear and coupler; and a drop-in removable Type E coupler support that is removably fittable within the integral spring basket and serves as a fixed lower carrier surface for rigidly supporting a Type E draft gear and coupler, wherein the main body is a standardized draft sill having a total length from the front face to the rear face sized to accommodate multiple railroad car configurations and at least two different weld-in plugs are mountable on the rear end face of the standardized main body, each different weld-in plug having a length and rear face shape that adapts the standardized main body of the draft sill to a center sill of a different railroad car configuration.

* * * * *